US006505445B2

(12) United States Patent
Johnson et al.

(10) Patent No.: US 6,505,445 B2
(45) Date of Patent: Jan. 14, 2003

(54) FLOATING COVER

(75) Inventors: Burton M. Johnson; William L. Wagner, both of Warren, PA (US)

(73) Assignee: Petrex, Inc., Warren, PA (US)

( * ) Notice: Subject to any disclaimer, the term of this patent is extended or adjusted under 35 U.S.C. 154(b) by 49 days.

(21) Appl. No.: 09/877,253

(22) Filed: Jun. 11, 2001

(65) Prior Publication Data

US 2002/0184838 A1 Dec. 12, 2002

(51) Int. Cl.[7] ..... E04H 5/08

(52) U.S. Cl. ..... 52/223.3; 52/223.3; 220/216; 220/220

(58) Field of Search ..... 52/223.3, 664, 52/665, 655.1; 220/216, 220, 222, 218

(56) References Cited

U.S. PATENT DOCUMENTS

| | | | | |
|---|---|---|---|---|
| 2,237,461 A | | 4/1941 | Tokheim | |
| 3,374,918 A | | 3/1968 | Creith | |
| 3,724,704 A | | 4/1973 | Edwards et al. | |
| 3,774,799 A | | 11/1973 | Heisterberg | |
| 3,910,452 A | | 10/1975 | Szasz | |
| 3,944,113 A | | 3/1976 | Heisterberg | |
| 3,972,444 A | * | 8/1976 | Adams | 220/216 |
| 3,980,199 A | | 9/1976 | Kays | |
| 4,036,394 A | * | 7/1977 | Bodley et al. | 220/222 |
| 4,202,460 A | | 5/1980 | Imbeault | |
| 4,213,280 A | | 7/1980 | Sandborn | |
| 4,243,151 A | | 1/1981 | Bruening | |
| 5,533,640 A | * | 7/1996 | Jolly | 220/216 |
| 5,628,421 A | | 5/1997 | Jolly | |
| 5,704,509 A | | 1/1998 | Rosenkrantz | |
| 6,193,092 B1 | | 2/2001 | Witter | |

* cited by examiner

*Primary Examiner*—Carl D. Friedman
*Assistant Examiner*—Yvonne M. Horton
(74) *Attorney, Agent, or Firm*—Robert E. Bushnell, Esq.

(57) ABSTRACT

A floating cover or roof having a plurality of floating panels or panels is provided. The floating cover disposed in a storage tank includes a frame having a plurality of openings, the floating panels mounted into the respective openings, an inspection port formed on an upper member of the floating panel and communicated with an inside of the floating panel. The inspection port provides the inspection of presence of moisture, vapor, and condensate trapped in the inside of each of the floating panels without disassembly of adjacent floating panels and also provides the replacement of damaged or degraded one among the floating panels without taking out the internal floating roof from the storage tank.

18 Claims, 11 Drawing Sheets

FLOATING COVER

BACKGROUND OF THE INVENTION

1. Field of the Invention

The present invention relates to a floating cover for a liquid storage tank, and more particularly, to a liquid surface contact internal floating cover constructed with a plurality of floating panels and process for monitoring leaks within each of the floating panels.

2. Description of the Background Art

Floating covers have previously been used inside cylindrical liquid storage tanks to ride vertically along the cylindrical wall of the tanks between the roof and bottom as the volume of fluid held by the tank varies. Typically, the floating cover floats above the liquid and moves up and down depending on the amount of the liquid. A plurality of buoyant panels or honeycomb type pans, are assembled to form the floating cover. This conventional floating cover, however, is expensive to manufacture and erect inside the frame of the tank. Accordingly, periodic inspection and maintenance of the cover is desirable in order to obtain the full life of the cover.

The current design for full surface contact floating covers uses honeycomb panels that are manufactured by bonding an aluminum channel frame to the honeycomb panel. The honeycomb panel may have all sealed cells or all interconnected cells. If some of the cells of an individually sealed honeycomb are opened to invasion of the product held by the tank, there is currently no way of detecting the invasion except by observation of the escaped product as it drips out of the panel after the tank has been taken out of service and emptied. The trapped liquid will however, slowly drip out of the panel and present a grave safety hazard to the maintenance people working within the interior of the tank. If a cell of an interconnecting cell type of honeycomb panel is violated, then all cells are violated, making it near impossible to find the original leaking cell. The whole panel must be replaced.

The owners and managers of tanks must periodically inspect the interior of the tank and make repairs. This entails a removal of the contents of the tank, a purging of gaseous phase vapors from the interior of the tank, an introduction of ambient atmospheric air into the interior of the tank and continuous or at least intermittent monitoring of the atmosphere within the interior of the tank. The owner of the tank needs assurance that before personnel enter the interior of the empty tank, and that while work (particularly using arc or open flame torches) is performed within the interior of the tank, that the tank has been completely emptied and cleaned, and is safe for both the personnel and the type of work being performed. This assurance requires that there be no remaining hazardous pockets of the contents of the tank within the floating roof.

Currently, contemporary designers of buoyant panels provide no convenient technique for detecting the presence of moisture and condensate within individual buoyant panels.

SUMMARY OF THE INVENTION

It is an object of the present invention to provide an improved floating roof.

It is another object to provide a floating roof and process for detecting the presence of vapor, moisture, or condensate which indicates leakage and the onset of deterioration of the integrity of the roof.

It is still another object to provide a floating roof assembled from multiple panels and a process for inspecting individual panels for the onset of deterioration.

It is yet another object to provide a floating cover able to remove and replace individual floating panels of a frame for the floating cover without interfering with the integrity of adjacent floating panels.

It is still yet another object to provide a floating cover that permits inspection of leakage of each of the floating panels forming the floating cover without disassembly of the floating cover.

It is a further object to provide a full liquid surface contact internal floating cover constructed with individual floatation panels that may be checked for leakage from the top side of the cover while the tank is in service.

It is still another object to provide a full liquid surface contact internal floating cover that accommodates vapor sampling of the entire interior volume of the floatation panels.

It is yet a further object to provide a full liquid surface contact internal floating cover assembled from floatation panels set into the frame of the cover from the top side of the floating roof.

It is a still yet further object to provide a full liquid surface contact internal floating cover assembled from a plurality of floatation panels, with adjacent panels allowing unrestricted removal of individual floatation panels.

It is also an object to provide a full liquid surface contact internal floating cover with a frame for support of discrete floatation panels that is constructed from rigid structural members.

It is also an object to provide a full liquid surface contact internal floating cover constructed from a plurality of floatation panels that are not relied upon for the structural rigidity of the cover and therefore are not subjected to failure due to metal fatigue.

It is also an object to provide a full liquid surface contact internal floating cover constructed from a plurality of floatation panels that may be leak tested at the point of manufacture as well as in the field after assembly of the cover.

It is also object to provide a floating cover that allows individual panels within the floating cover to be inspected without detaching either the particular panel being inspected or any adjacent panel from the floating cover.

These and other objects may be achieved by providing a storage tank with a floating cover including a frame having a plurality of openings, a plurality of floating panels mounted into the respective openings in the frame, an inspection port formed on an upper member of each of the floating panels that when opened, communicates with an hollow cavity interior of the floating panel, and a cap covering the inspection port of the floating panel. The presence of moisture and condensate contained in any of floating panels can be visually detected through the inspection port of the each of the floating panels without disassembling any of the floating panels or without removing the entire floating cover from the storage tank.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbol indicate the same or similar components, wherein:

FIG. 12 is a partial plan view showing moisture and condensate found in the floating panel through the inspection port; and.

DETAILED DESCRIPTION OF THE INVENTION

Figure 1:
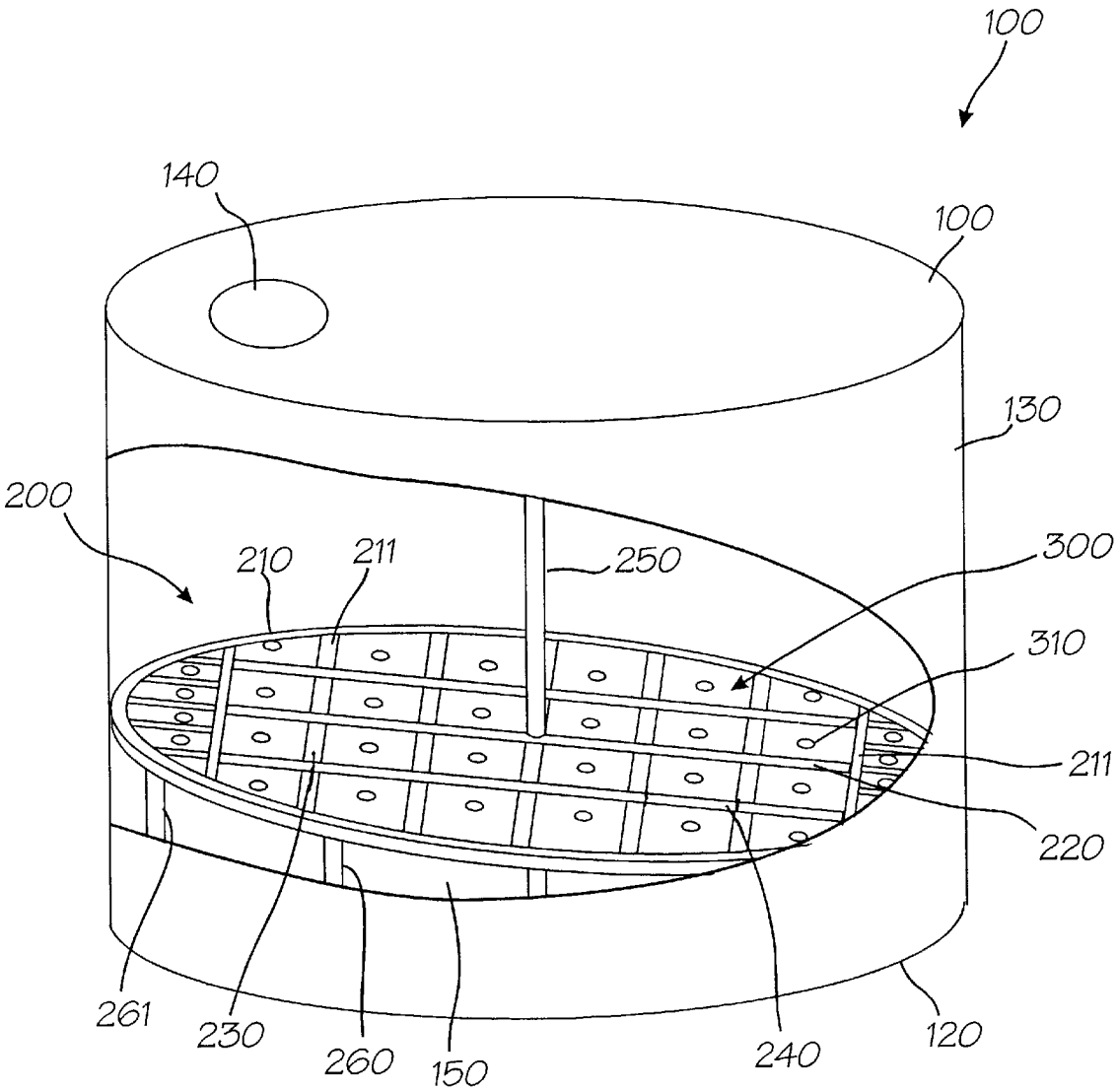
FIG. 1 is a perspective view of a storage tank with a broken wall showing a floating cover constructed according to the principles of the present invention.

Turning now to the drawings, FIG. 1 illustrates a storage tank 100 defining a roof 110, a bottom 120, and a hollow cylindrical wall 130, that is provided with a floating cover 200 constructed according to the principles of the present invention. A passage 101 is formed on roof 110 of storage tank 100 and provides an easy access into floating cover 200 contained inside storage tank 100. A plurality of girders 220, main beams 230 and cross beams 240, such as "H" shaped steel beams or "I" steel beams, are connected inside a circular rim 210 while a plurality of floating panels 300 are mounted onto respective individual separated openings provided among girders 220, main beams 230, and cross beams 240. A central post 250 is installed on a central portion of floating cover 200, and a plurality of rim legs 261 and main legs 260 are mounted on rim 210 and girders 220, respectively, in order to support floating cover 200 within storage tank 100. Floating cover 200 floats over the full surface of liquid 150 that fills the space provided between the underside of the floating cover 200 and bottom 120 of storage tank 100. Floating cover 200 moves up and down together with the surface of liquid 150 as a function of the volume of fluid within tank 100.

Since each bottom of floating panels 300 of floating cover 200 is lower than the level of the liquid 150 contained in storage tank 100. and since roof 110 may be damaged to the point of leaking, moisture and condensate, as well as some of the product stored within the tank, may be present in an inside of one or each of floating panels 300 through damaged seams or a crack usually in the underside of the panel. An inspection port 310 formed on each of floating panels 300 that is shown in greater detail provides each of floating panels 300 with the inspection of each of floating panels 300 for leakage without disassembly of any of the adjacent floating panels 300.

Figure 2A:
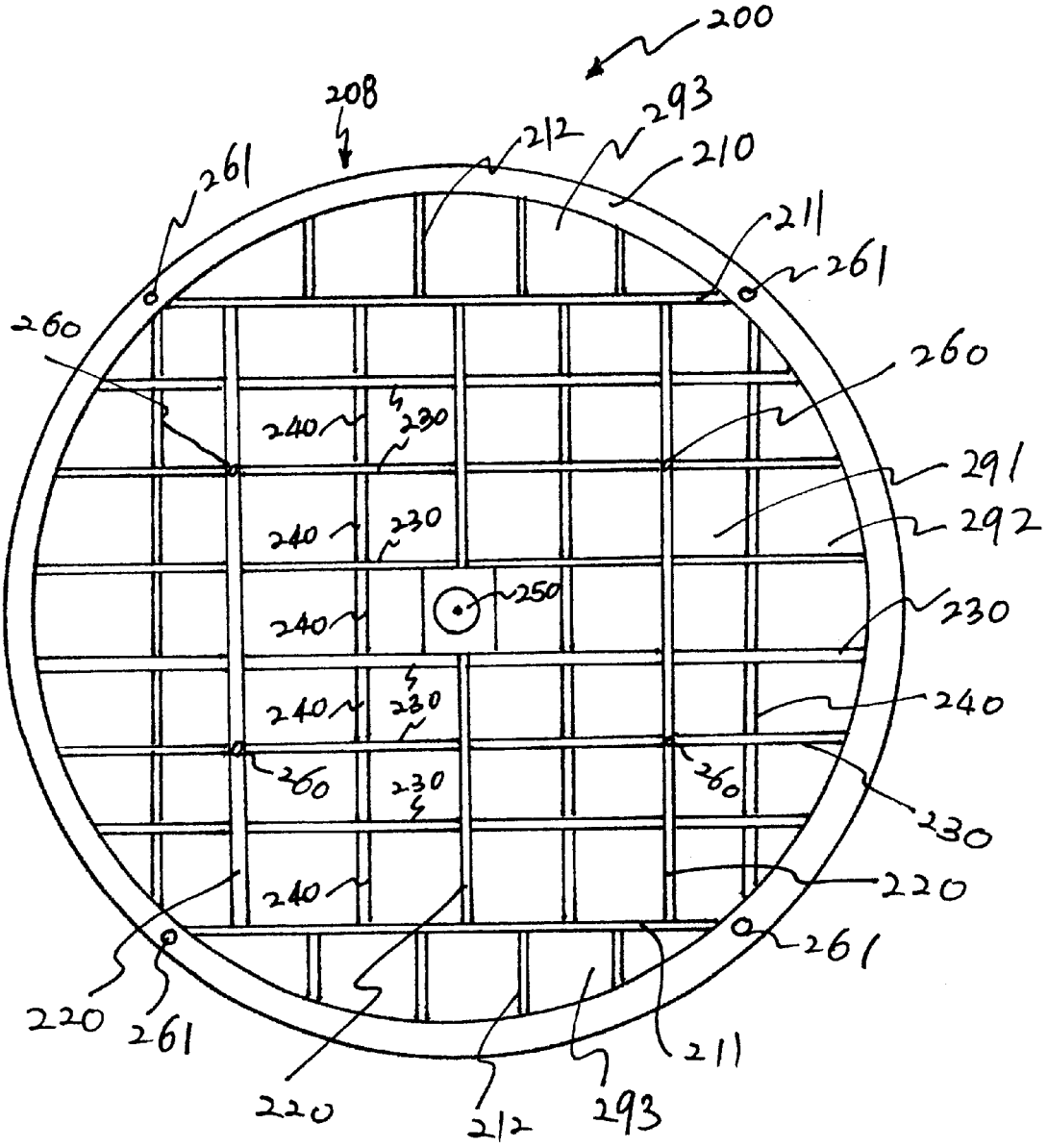
FIGS. 2A through 2D show a frame structure of the floating cover of FIG. 1.

FIG. 2A shows a plan view of a frame 208 including a rim 210, a pair of side beams 211 coupled to rim 210. a plurality of girders 220 connected between side beams 211, a plurality of main beams 230 coupled between girders 220, and a plurality of cross beams 240 coupled between main beams 240 and between side beam 211 and rim 210. Central post 250 is mounted on one of girders 220, and main legs 260 and rim legs 261 are mounted on girders 220 and rim 210, respectively, and protrude toward bottom 120 of storage tank 100. Cross beams 240 are parallel to each other while main beams 230 are perpendicular to both cross beams 240 and girders 220 and are parallel to side beams 211. Openings 291, 292, 293 showing a plurality of different shapes are provided by cross beams, girders 220, and main beams 230 or by rim 210, cross beams 240, and side beams 211. The shape of floating panels 300 corresponds to the each of different shape of openings 291, 292, 293.

Figure 2B:
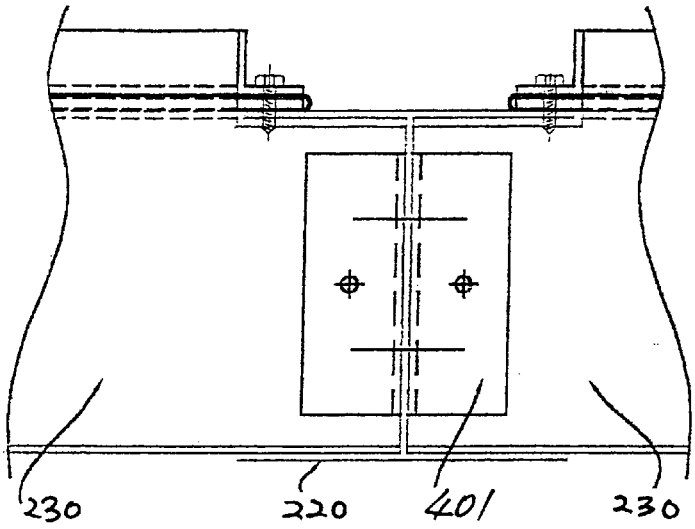
Figure 2C:
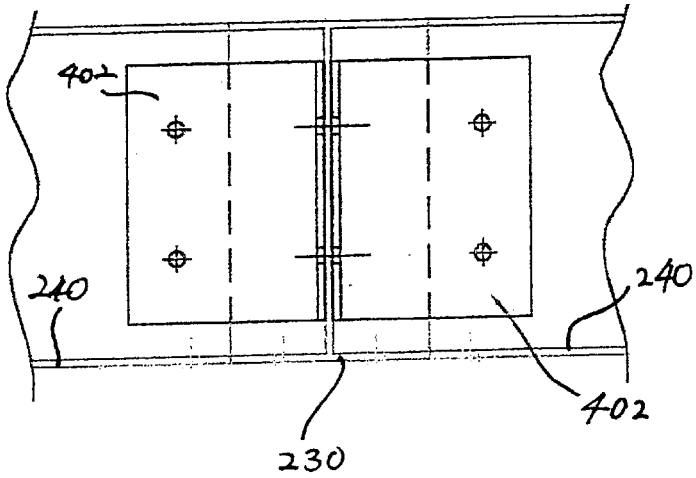
Figure 2D:
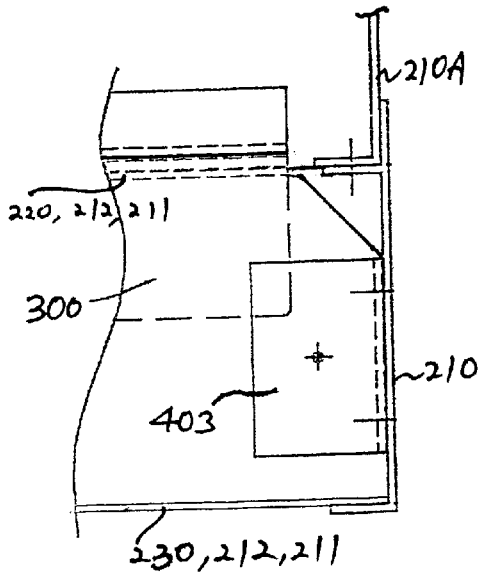

FIGS. 2B through 2D show angles 401, 402, 403 coupled between girder 220 and main beam 230, between main beam 230 and cross beam 240, and between rim 210 and main beam 220, side beam 211, or cross beam 212, 240, respectively. Two webs of girder 220 and main beam 230 are coupled by a pair of angles 401 as shown in FIG. 2B. Two webs of main beam 230 and cross beam 240 are spaced-apart from each other and coupled by a pair of angles 402 as shown in FIG. 2C. One of main beam 230, side beam 212, and cross beam 211, 240 may coupled to rim 210 by angle 403. A rim extension 210A is extended upward from rim 210. Floating unit 300 is coupled to a flange of main beam 230, side beam 211, or cross beam 211, 240.

Figure 3:
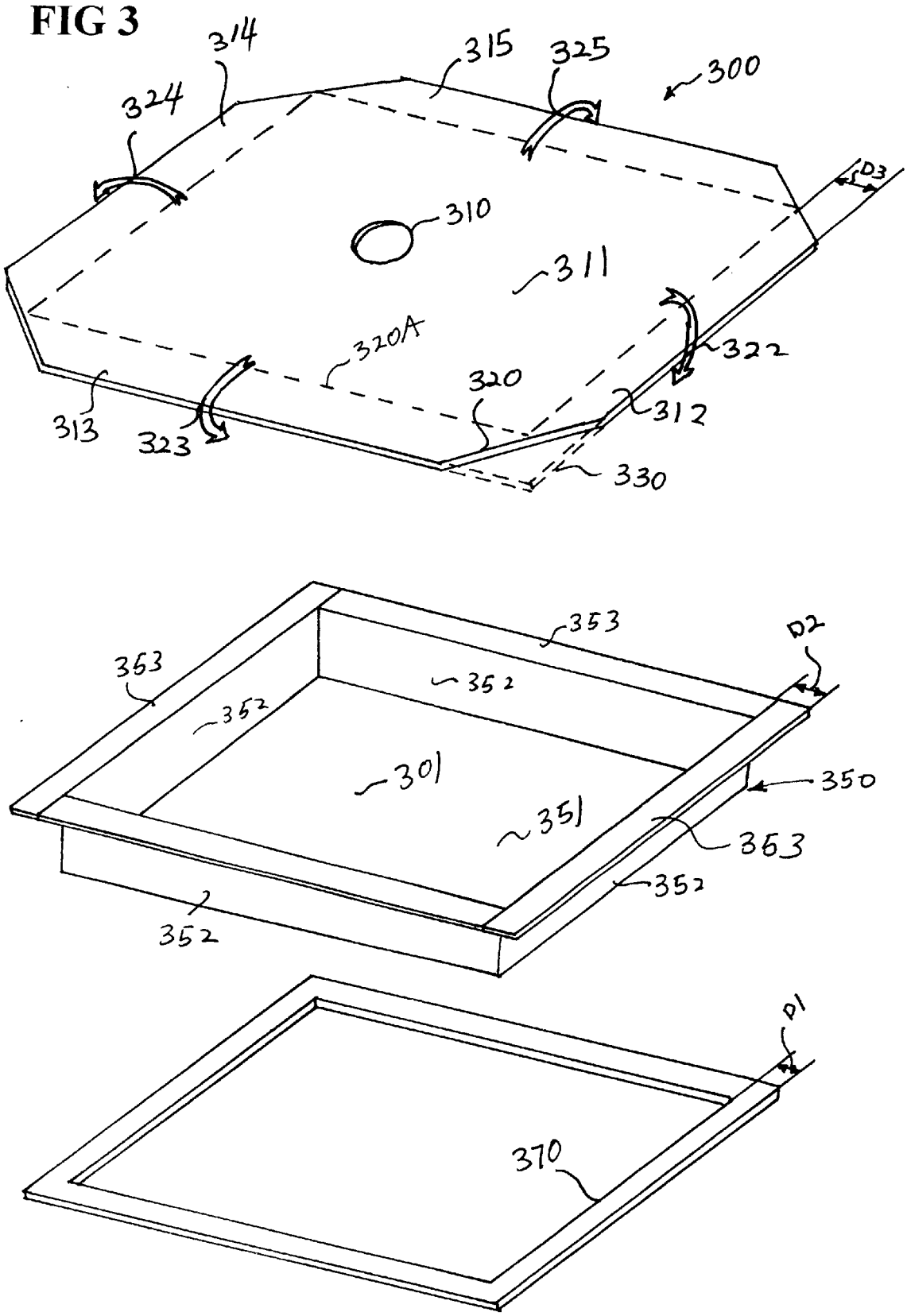
FIG. 3 is an exploded perspective view of a floating panel in the floating cover of FIG. 2.

FIG. 3 shows floating panel 300 including a lower member 350 defining a bottom 351, four side walls 352 having a predetermined depth, and extensions 353 extended from each longitudinal end of side walls 352 by a length D2. A sealant 370, such as a rubber material, having a length D1 is disposed a bottom side of extension 353 of lower member 350. A upper member 311 includes an inspection port 310 and four end covers 312, 313, 314, 315 disposed outer peripheral sides of upper member 311 to be bent about a broken line 320A in a direction 322, 323, 324, and 325, respectively. A length D3 of end cover is greater than the sealant 370 and extensions 353. Four cutout portions 330 are formed at each comer of upper member 311 by a cutout line 320 in order to allow end covers 312, 313, 314, 315 to be bent in the direction 322, 323, 324, 325, respectively.

Figure 4:
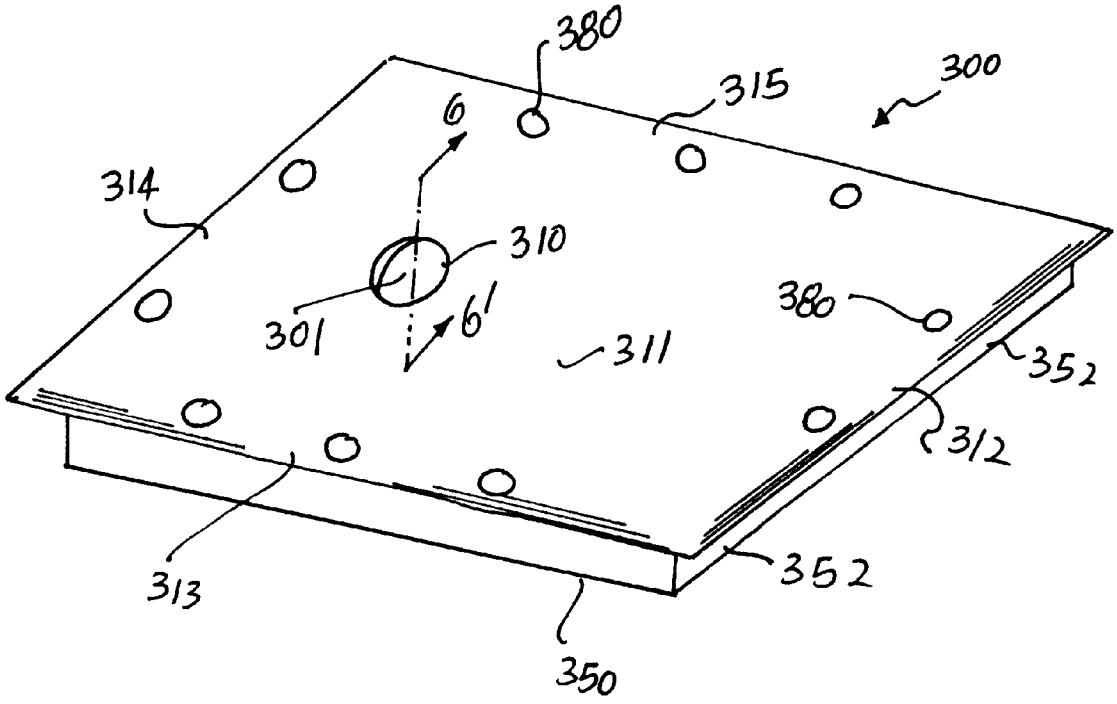
FIG. 4 is a perspective view of the floating panel of FIG. 3.

Upper member 311 is placed on extensions 353 of lower member 350, and end covers 312, 313, 314, 315 are bent in the direction 322, 323, 324, 325, respectively in order to cover extensions 353 and sealant 270. Once upper member 311, lower member 350, and sealant 370 are assembled into floating panel 300, coupling holes 380 are formed on each side of floating panels 300 as shown in FIG. 4. Upper member 311 is spaced apart from bottom 351 of lower member 350 in order to provide a hollow inside 301 which may be communicated with an outside of floating panels 300 through inspection port 301. Sealant 370 is disposed between extensions 353 of lower member 350 and end covers 312, 313, 314, 315 of upper member 311 to make secure against leakage between upper member 311 and lower member 350. In FIG. 4, upper member 311 is assembled into floating panel 300 with sealant 370 and lower member 350.

Figure 5:
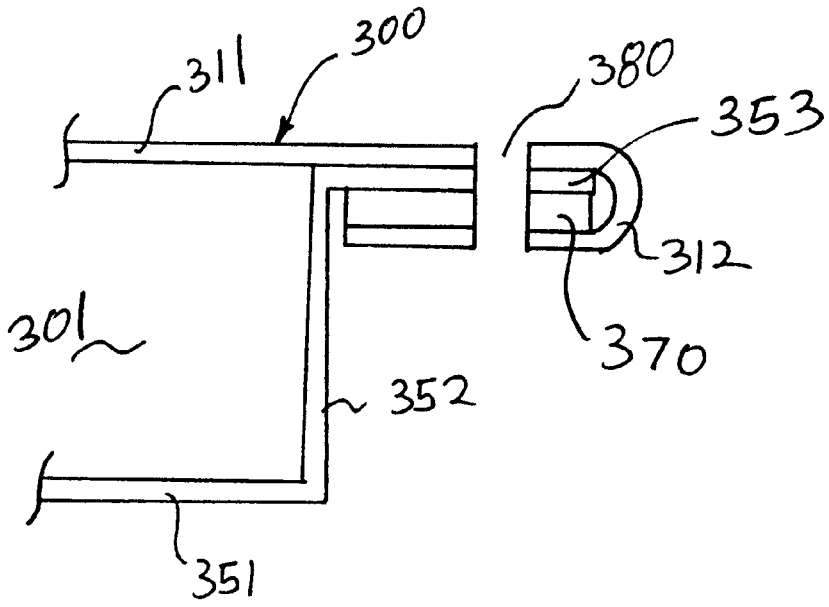
FIG. 5 is a partial cross-sectional view taken along line 5–5' of FIG. 4.
Figure 6:
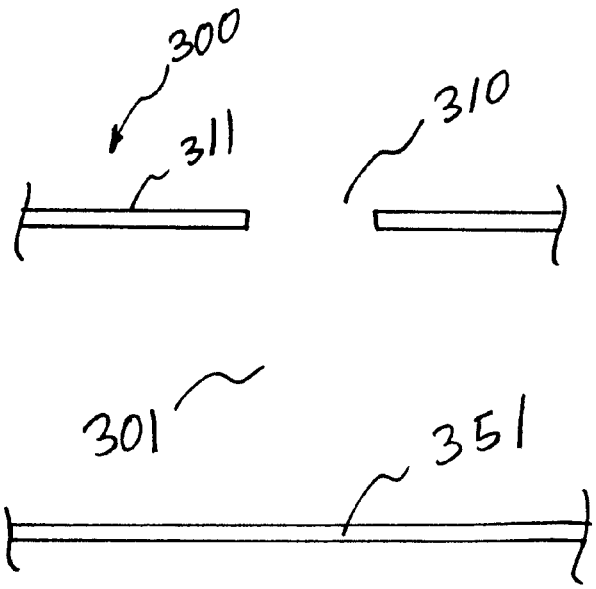
FIG. 6 is a partial cross-sectional view taken along line 6–6' of FIG. 4.

FIG. 5 shows floating panel 300 having end cover 312 bent in the direction 322 and surrounding extension 353 of lower member 350 and sealant 370. Coupling hole 380 is formed through end cover 312 of upper member 311, extension 353 of lower member 350, and sealant 370. FIG. 6 shows a cross sectional view taken along 6–6' of FIG. 4B. Upper member 311 is spaced apart from bottom 351 of lower member 350, and a sealed hollow inside 301 is provided between upper member 311 and bottom 351 of lower member 350. Each inspection port 310 provides a passageway between hollow inside 301 and an outside of floating panel 300.

Figure 7:
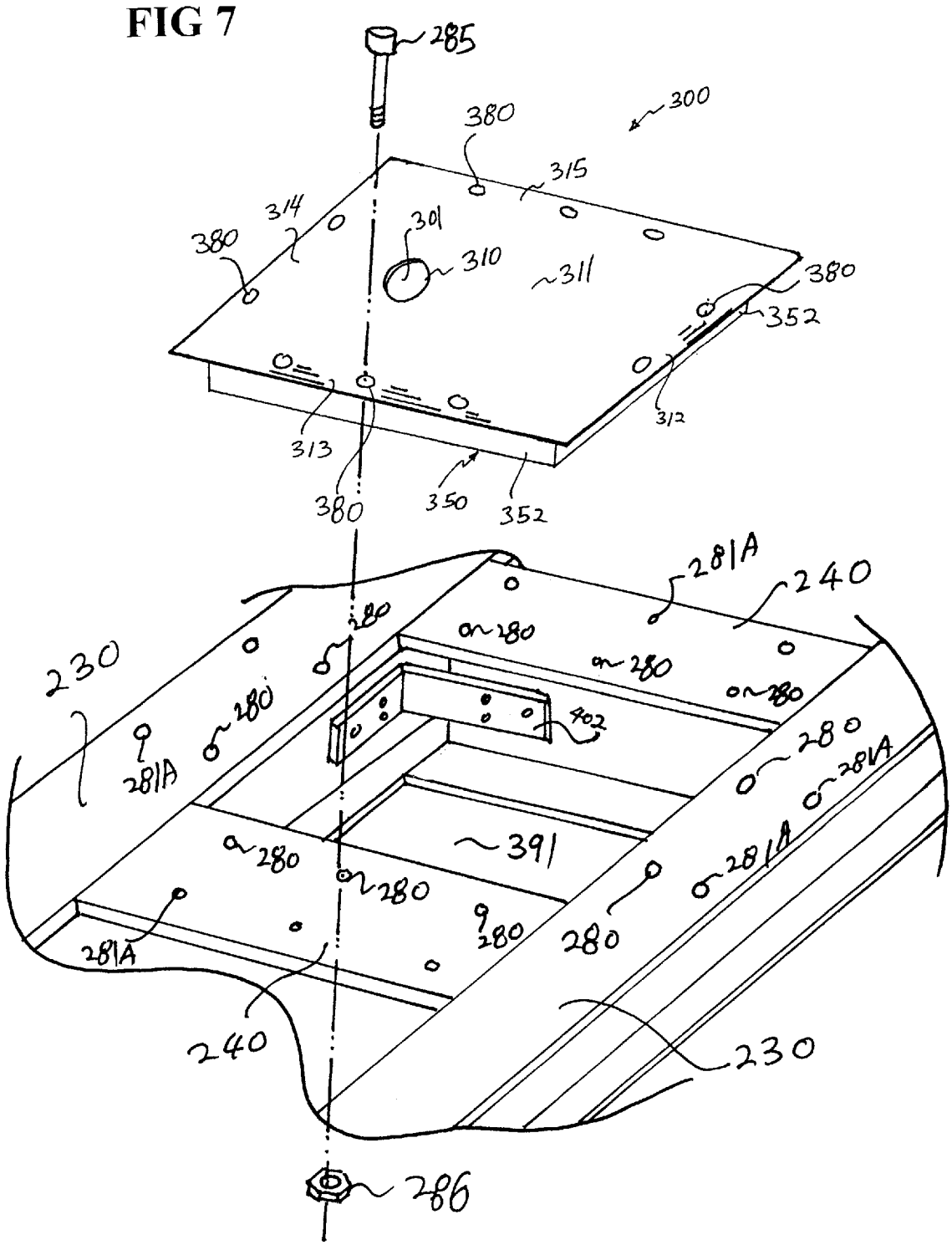
FIG. 7 is an exploded perspective view of a frame of the structure for the floating cover and a complete floating panel assembled with the frame structure.
Figure 8:
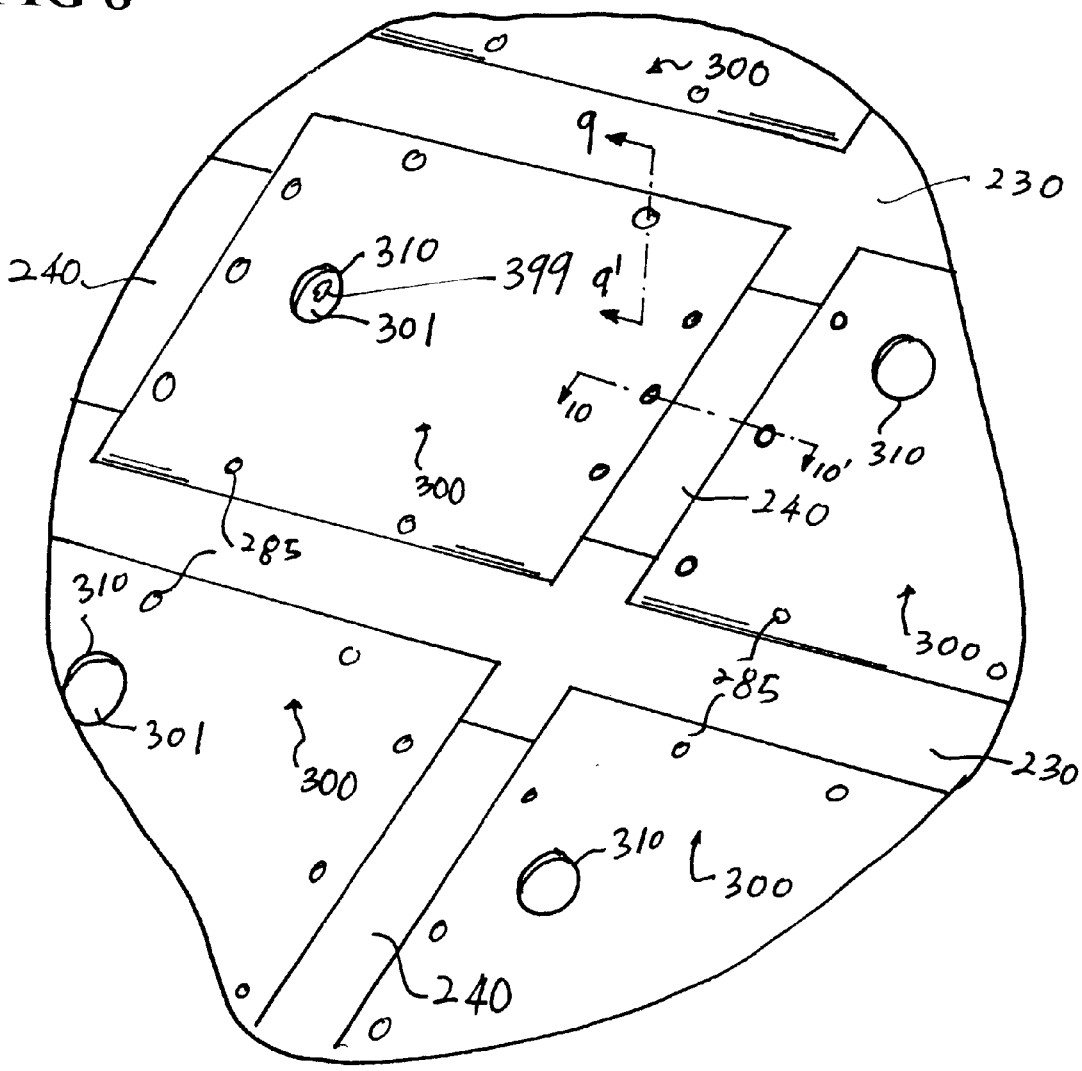
FIG. 8 is a partial perspective view of the floating cover formed by an assembly of a plurality of the floating panels.

FIGS. 7 and 8 show floating panels 300 inserted into respective openings 391 and coupled to main beams 230 and cross beams 240. A plurality of coupling holes 280 are formed on main beams 230 and cross beams 240 for coupling one of floating panels 300 to main beams 230 and cross beams 240. A plurality of second coupling holes 280A are formed on main beams 230 and cross beams 240 and spaced apart from first coupling holes 280. Adjacent floating panels 300 are coupled to main beams 230 and cross beams 240 through second coupling holes 280A. An angle 402 is disposed between cross beam 240 and main beam 230 to attach cross beam 240 to main beam 230. A various types of couplers 401, 402, 403 may be used for coupling side beams 211 to rim 210, girders 220 to side beams 211, main beams 230 to girders 220, and cross beams 240 either between main beams 220 or between rim 210 and side beams 211. A bolt 285 passes through coupling holes 380 and 280 or 280A to be coupled to a nut 286 in order to attach each of floating panels 300 to main beams 230 and cross beams 240.

FIG. 8 shows the floating panels of FIG. 4 assembled into frame 208 of floating cover 200. Each individual inspection port 310 is shown in each of individual floating panels inserted into respective openings 291 and attached to main beams 230 and cross beams 240. Each one of floating panels is spaced-apart from adjacent floating panels and is coupled to main beams 230 and cross beams 240 without being coupled to the adjacent floating panel and without interfering the assembly of the adjacent floating panels. During attaching one of the floating panel 300 to main beams 230 and cross beams 240 or during detaching one the floating panel 300 from main beams 230 and cross beams 240, the one of the floating panels 300 does not interfere the adjacent floating panels. One of floating panels 300 is replaced with new one without disassembling the adjacent floating panels from main beams 230 and cross beams 240 of frame 208 of floating cover 200.

Since hollow inside 301 of floating panel 300 is communicated with the outside of floating panels 300 through each individual inspection port 310, bottom 351 of lower member 350 of floating panels 300 can be seen through individual inspection port 310. Individual inspection port 310 is formed on a predetermined position on upper member 311 in order to provide a passageway through which an inspection tool is inserted into hollow inside 301 of floating panel 300 or through bottom 351 of lower member is inspected. Inspection port 310 may be used for sniffing the interior of floating panel 300 with the inspection tool, such as a gas vapor monitor, instead of trying to look through inspection port 310. Individual inspection port 310 may be formed on a central portion or a corner portion of upper member 311 depending on a user's selection. Therefore, inspection port 310 is disposed to allow a user to inspect hollow inside 301 with any of naked eyes and the inspection tool. A plurality of inspection ports may be formed on upper member 311 in order to provide the user with the full inspection of the entire inside 301 of floating panels.

In FIG. 8, moisture and condensate 399 presented in one of floating panels 300 become visible through inspection port 310. If one of roof 100 and floating cover 200 is damaged, if the seam of each of floating panels 300 of floating cover 200 is broken, or if the seal of sealant is loosened, moisture and condensate 399 are presented in hollow inside 301 of floating panels 300 and accumulated in bottom 351 of lower member 350 of floating panels 300. The disassembly of any of floating panels 300 from frame 208 of floating cover 200 is not needed. A user may inspect the presence of the moisture and condensate 399 through inspection port 3 10 formed on each of floating panels 300 without disassembly of any of floating panels 300 or any of adjacent floating panels 300. Moreover, the floating cover 200 does not need to be taken out from the storage tank 100.

Since the coupling of one floating panel to beams does not affect the coupling of the adjacent floating panels to beams of frame 208, the processing time for assembling floating panels to beams is shortened, and the cost for manufacturing floating panels and assembling the floating cover is significantly reduced. Moreover, it is very convenient and very advantageous for a user to replace a damaged floating panel with a new floating panel, thereby reducing the time and cost for the replacement of the damaged floating panels.

Since floating panels 300 and frame 208 are separately manufactured in a factory or in different factories located in different locations and are assembled into floating cover 200 inside storage tank 100, each of floating panels 300 may be individually inspected in the factory and also individually inspected before and after floating panels 300 are assembled. Each inspection of floating panels 300 in both sites of the factory and storage tank 100 before and after the assembly of the floating cover 200 is more great advantageous for the user and manufacturer.

Figure 9:
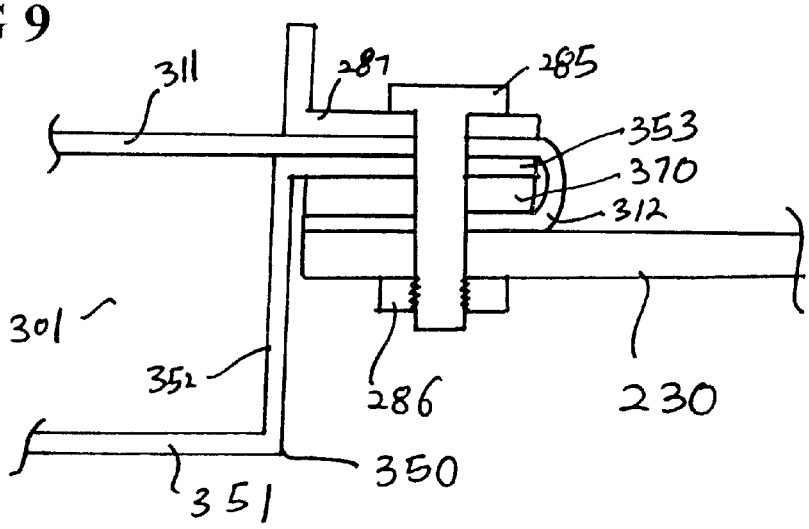
FIG. 9 is a partial cross-sectional view taken along line 9–9' of FIG. 8.
Figure 10:
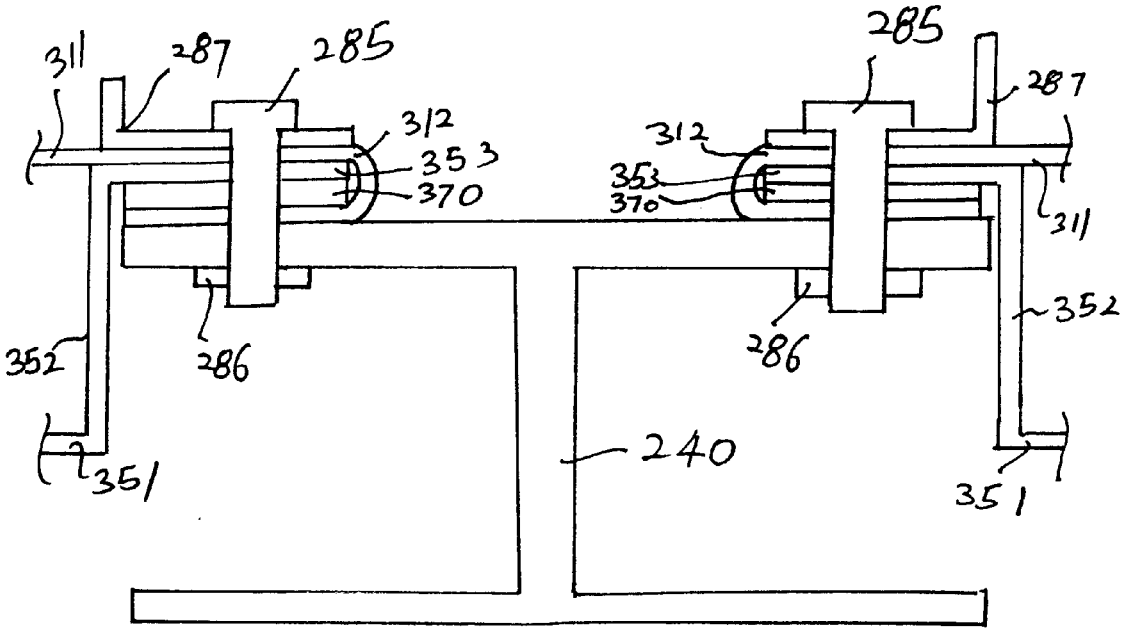
FIG. 10 is a partial cross-sectional view taken along line 10–10' of FIG. 8.

FIGS. 9 and 10 show a partial cross sectional view taken along lines 9–9' and 10–10', respectively. Floating panel 300 is coupled to main beam 230 by bolt 285 and nut 286. A bush 287 is inserted between bolt 285 and end cover 312 of upper member 311 and may be inserted between end cover 312 and main beam 230 or between main beam 230 and nut 286.

Two adjacent floating panels 300 are coupled to each of horizontal extensions of cross beams 240 and spaced-apart from each other. Because each floating panel includes each individual hollow inside and each individual inspection hole, each individual floating panel can be inspected while adjacent individual floating panel maintains a coupling state to girders 220, main beams 230, or cross beams 240.

Figure 11A:
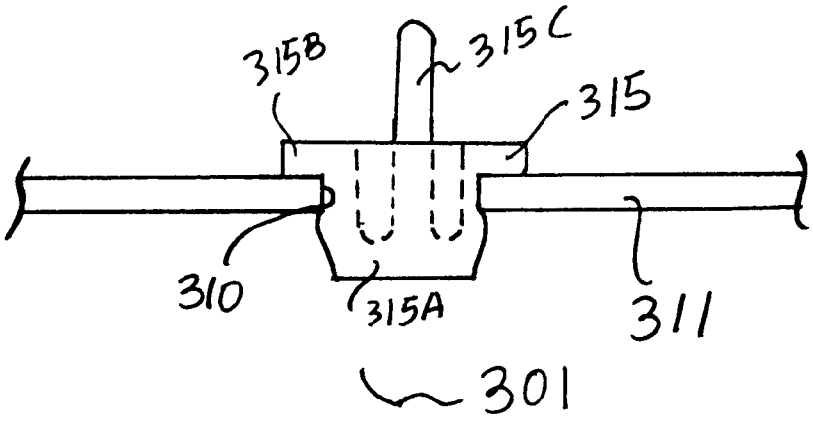
FIGS. 11A and 11B are partial cross-sectional views of a cap mounted on an inspection port of an upper member of the floating panel constructed according to the principles of the present invention.
Figure 11B:
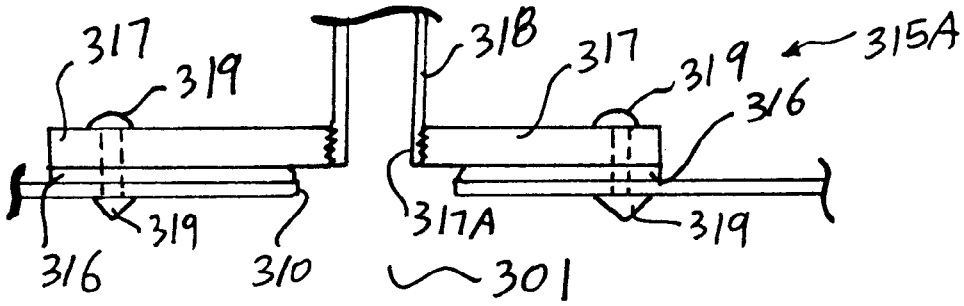
Figure 12:
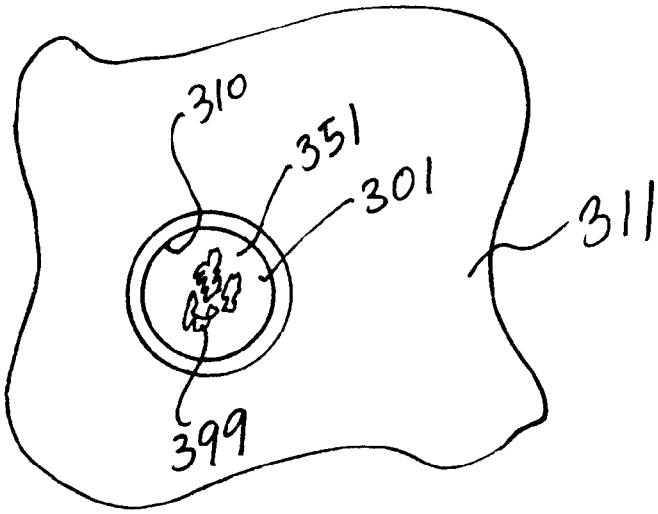

FIGS. 11A and 11B show various types of mechanisms, such as plastic plugs, elastic rubber plugs, adhesive tapes, pipes, etc. A removable plug as shown in FIG. 11A is inserted into inspection port 310 in order to close and open inspection port 310 of upper member 311 and in order to prevent foreign material from being introduced into hollow inside 301 of floating panel 300. Plastic plug 15 defines a main body 315A inserted into hollow inside 301 through inspection port 310 and having a diameter greater than inspection port 310, a stopper 315B radially extended from main body 315A, and a handle protruded from main body 315A toward an outside of floating unit 300. In FIG. 11B, an additional member 315A is removably mounted on upper member 311 when upper member 311 is not thick enough to couple an air line or pipe to inspection port 310. A thicker plate 317 couples an air line or pipe to inspection port 310. A thicker plate 317 is coupled to upper member 311 by couplers 319. A sealant 316 is disposed between upper member 311 and plate 317. A removable air line or pipe 318 is fitted into a second port 317A. FIG. 12 shows moisture and condensate 399 contained and accumulated in floating panel 300 and being visible through inspection port 310. Inspection part 310 may have a circular shape, an elongate shape, or an elliptical shape. The shape of plug 315 varies depending on the shape of inspection port 310.

Figure 13:
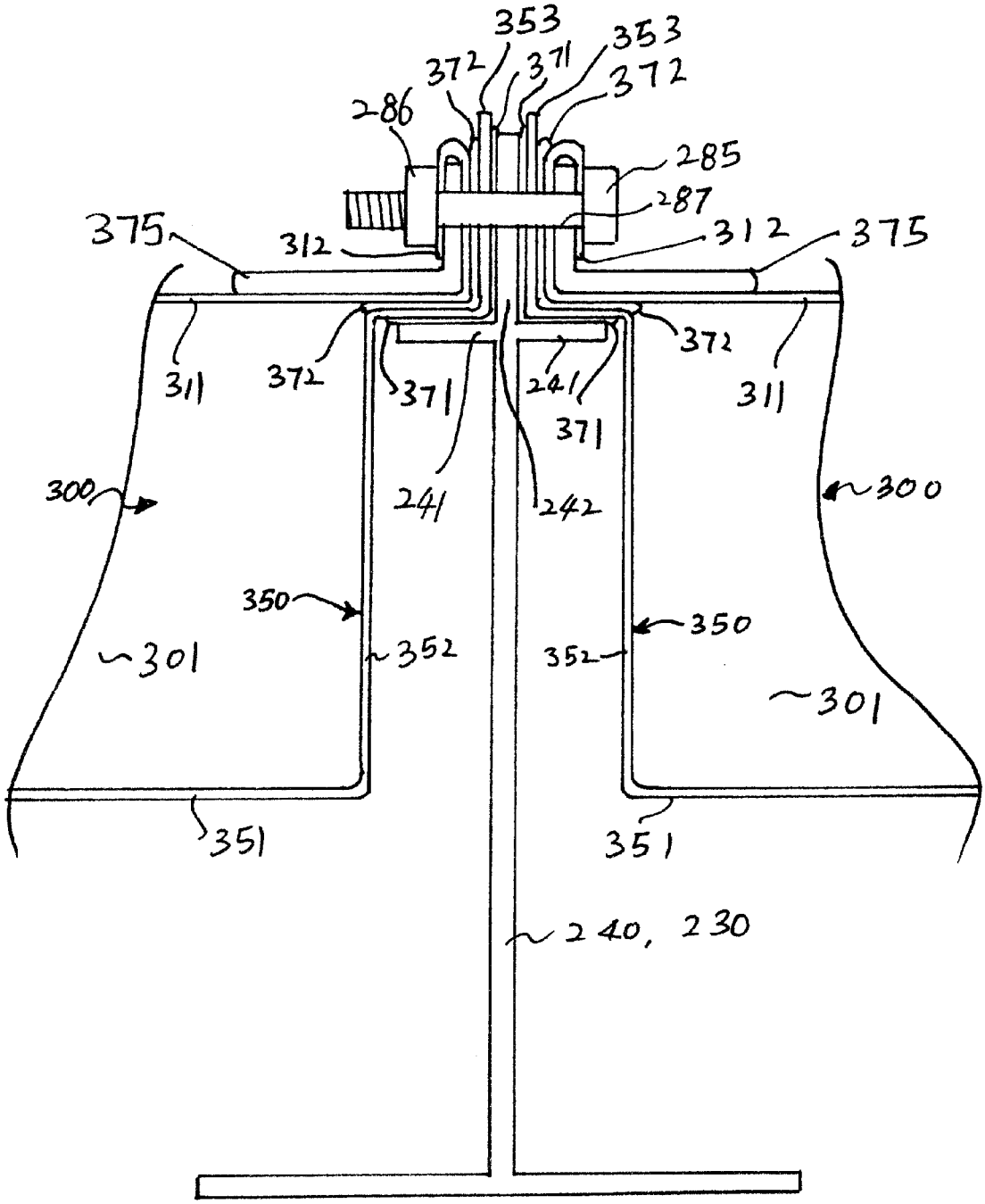
FIG. 13 is another embodiment of the floating cover coupled to the frame structure.

FIG. 13 shows another embodiment of the coupling between floating covers 300 and main beam 230 or cross-beam 240. Adjacent floating panels 300 are disposed on respective extensions 241 with respect to a flange 242 of beam 230, 240. A first sealant 371 is disposed between extension 353 of lower member 350 and both extension 241 and flange 242 o f beam 230, 240. A second sealant 372 is disposed between extension 353 of lower member 350 and end cover 312 of upper member 311. End cover 312 is bent to cover an auxiliary angle 375. Bolt 285 is coupled to nut 286 through a connecting hole 287 formed on flange 242, first sealant 371, extension 353 of lower member, second sealant 372, end cover 312 of upper member 311, and auxiliary angle 375. Although adjacent floating panels 300 are coupled to beam 230, 240, the inspection for the presence of vapor, moisture, and condensate is established through inspection port 310 formed on respective floating panels 300 without disassembling adjacent floating panels 300. Even if one of floating panels 300 is violated, the one of floating panels can be replaced only with the decoupling of bolt 285 and nut 286 from connecting hole 289. Adjacent floating panels 300 remain in respective openings 291, 292, 293 of floating cover 200 during replacement of the one of adjacent floating panels 300.

As mentioned above, the floating cover or roof is provided with a plurality of floating panels or panels each having respective inspection port constructed according to the principle of the present invention. With the inspection port, damaged or degraded floating panels or panels may be inspected and replaced without decoupling the adjacent floating panels from the floating cover and without taking out the floating cover or roof from the storage tank. The entire floating cover does not need to be replaced. Rather, the damaged and degraded one among the floating panels is replaced with a new floating panel after a convenient inspection of the presence of moisture and condensate trapped in the trough or the inside of each floating panels through each inspection port formed on each of floating panels or panels.

Although the preferred embodiment of the present invention has been shown and described, it will be appreciated by those skilled in the art that changes may be made in these embodiments without departing from the principles and spirit of the invention, the scope of which is defined in the claims and their equivalents.

What is claimed is:

1. A floating cover in a storage tank, comprising:

a frame having a plurality of innerconnected members forming a plurality of discrete openings, said frame defining a full surface liquid contact cover floating above a surface of any liquid stored in the storage tank;

a plurality of floating panel members each conforming in a shape to a different corresponding one of said openings and coupling to said innerconnected members, said floating panel members each having an upper pan and a lower pan attached to an exterior rim of said upper pan, said floating panel members each having a hollow inside formed between said upper and lower pans; and an inspection port formed on said upper pan of each of said floating panel members, providing a visual inspection into said hollow inside from top side of said floating panel member.

2. The floating cover of claim 1, further comprising a sealant disposed between said exterior rim of said upper pan and said lower pan.

3. The floating cover of claim 2, wherein moisture or condensate permeated through inner edges formed between said upper pan and said lower pan and condensed on an inner surface of said upper pan drips onto an inner surface of said lower pan when said sealant is degraded.

4. The floating cover of claim 3, wherein the moisture or condensate is visible from said top side of said floating panel member through said inspection port.

5. The floating cover of claim 1, wherein one of said floating panel members is coupled to said frame without interfering the assembly of adjacent floating panel members which are inserted into each corresponding opening formed on said frame and are coupled to said frame.

6. The floating cover of claim 1, wherein one of said floating panel members is detached from said frame without detaching any of adjacent floating panel member from said frame.

7. A floating cover in a storage tank, comprising:

a frame having a rim and a plurality of beams arranged within and coupled to said rim to provide a plurality of separate and individual openings;

a plurality of floating panels each inserted into each corresponding one of said separate and individual openings and coupled to said beams or rims, said floating panels spaced-apart from each other, said floating panels each having an individual sealed hollow inside; and an inspection port formed on each of said floating panels to communicate with said individual sealed hollow inside.

8. The floating cover of claim 7, with said floating panels each coupled to said beams without being coupled to an adjacent floating panel.

9. The floating cover of claim 7, wherein moisture and condense trapped in said hollow inside of each floating panel is seen through said inspection port.

10. The floating cover of claim 7, with said floating panels each comprising an upper, member and a lower member coupled on a lower side of a rim of said upper member, said hollow inside formed between said upper member and said lower member, and a sealant disposed between said rim of said upper member and said lower member.

11. The floating cover of claim 10, wherein said lower member is visible through said inspection port from outside said floating cover.

12. The floating cover of claim 10, with said hole formed on said upper member.

13. The floating cover of claim 10, with said lower member defining a bottom, four sidewalls raised from said bottom by a predetermined height, and four extensions each extended from respective sidewalls and coupled to said upper member.

14. The floating cover of claim 10, with said upper member including four end covers bent toward a bottom side of each extension of said lower member and clipping and covering said corresponding extension of said lower member.

15. A process for a floating cover, comprising the steps of:

providing a frame having a plurality of beams fabricated within said frame, said beams providing a plurality of separate and individual openings; and providing a plurality of floating panels each having an upper panel, a lower panel coupled to said upper panel an individual sealed hollow formed between said upper panel and said lower panel, and an individual inspection hole formed on said upper panel to communicate with said hollow; and coupling each one of said floating panels to said beams after each of said floating panels is placed into corresponding one of said openings without interfering the coupling of adjacent floating panels.

16. The process of claim 15, wherein said inspection port enabling a user to inspect said hollow of said floating panels from an outside of said floating panels.

17. The process of claim 15, further comprising a sealant disposed between said upper panel and said lower panel.

18. The process of claim 17, wherein moisture and condensate permeated through inner edges between said upper panel and said lower panel through said sealant and condensed on an inner surface of said upper panel drips onto an inner surface of said lower panel and is visible through said inspection port from outside of said floating cover.

* * * * *